US011999522B2

(12) United States Patent
Crosby

(10) Patent No.: US 11,999,522 B2
(45) Date of Patent: Jun. 4, 2024

(54) ADJUSTABLE FORMING COLLAR ASSEMBLY

(71) Applicant: Southwest FormSeal, Inc., Houston, TX (US)

(72) Inventor: Jason R. Crosby, Richmond, TX (US)

(73) Assignee: SOUTHWEST FormSeal, Inc., Houston, TX (US)

( * ) Notice: Subject to any disclaimer, the term of this patent is extended or adjusted under 35 U.S.C. 154(b) by 0 days.

(21) Appl. No.: 17/987,375

(22) Filed: Nov. 15, 2022

(65) Prior Publication Data

US 2023/0150706 A1 May 18, 2023

Related U.S. Application Data

(60) Provisional application No. 63/279,288, filed on Nov. 15, 2021.

(51) Int. Cl.
*B65B 59/00* (2006.01)
*B65B 9/20* (2012.01)

(52) U.S. Cl.
CPC ..... *B65B 59/003* (2019.05); *B65B 9/20* (2013.01)

(58) Field of Classification Search
None
See application file for complete search history.

(56) References Cited

U.S. PATENT DOCUMENTS 3,155,018 A * 11/1964 Kirsten ..... B29C 53/52 493/465
3,296,770 A * 1/1967 Wilson ..... B65B 37/18 53/552
3,415,171 A * 12/1968 Wilson ..... B65B 59/001 53/551

FOREIGN PATENT DOCUMENTS

WO WO-2019229258 A1 * 12/2019 ..... B65B 59/00

* cited by examiner

*Primary Examiner* — Tanzim Imam
(74) *Attorney, Agent, or Firm* — Wood, Phillips, Katz, Clark & Mortimer

(57) ABSTRACT

An adjustable forming collar assembly is provided for a form, fill and seal apparatus having a forming tube about which packaging film is positioned for formation and filling of a package. The adjustable forming collar assembly includes a mounting plate positioned to extend laterally on opposite sides of the forming tube. To accommodate filling of packages of differing sizes, first and second forming segments are provided which can be adjustably positioned on the mounting plate. Each of the forming segments is shaped to guide the packaging film from a generally flat configuration to a tubular configuration extending about the forming tube. The forming segments are adjustably positionable on the mounting plate. By this arrangement, the first and second forming segments can be selectively positioned toward and away from to each other on the mounting place, and thus adjustably positioned with respect to the forming tube, to thereby selectively adjust that size of the package being formed and filled. The assembly further includes first and second rib cages which can be adjustably positioned with respect to the forming tube to further accommodate formation and filling of differently sized packages.

8 Claims, 3 Drawing Sheets

ADJUSTABLE FORMING COLLAR ASSEMBLY

CROSS-REFERENCE TO RELATED APPLICATIONS

This application claims priority of Provisional Ser. No. 63/279,288, filed Nov. 15, 2021, the disclosure of which is hereby incorporated by reference in its entirety.

FEDERALLY SPONSORED RESEARCH OR DEVELOPMENT

Not Applicable.

MICROFICHE/COPYRIGHT REFERENCE

Not Applicable.

FIELD OF THE INVENTION

The present invention relates generally to packaging equipment for forming and filling flexible packaging, and more particularly to an adjustable forming collar assembly for use with an associated vertical form, fill and seal apparatus to facilitate formation and filling of packages of differing sizes.

BACKGROUND OF THE INVENTION

Forming collar assemblies (FCA) are interchangeable tooling that is installed in a Vertical Form, Fill and Seal (VFFS) packaging machine. Typically, forming collar assemblies are only designed and manufactured to form a single specific bag width size. To create a different pillow pack width on a VFFS requires a differently sized forming collar assembly.

The present invention is directed to an improved forming collar assembly for use on vertical form, fill and seal apparatus which facilitates efficient adjustment of the apparatus for formation and filling of differently sized packages.

SUMMARY OF THE INVENTION

In accordance with the present invention, an adjustable forming collar is a unique forming collar design that allows a traditional forming collar to be adjusted for multiple bag sizes on the same platform base using change-out parts. Versatile use of the associated form, fill and seal apparatus is thus facilitated, including efficient reconfiguration for filling of differently sized packages.

In accordance with the illustrated embodiment, an adjustable forming collar assembly is provided for a form, fill and seal apparatus having a forming tube about which packaging film is positioned for formation and filling of a package. The adjustable collar assembly includes a mounting plate positioned to extend laterally on opposite sides of the forming tube.

To accommodate filling of packages of differing sizes, first and second forming segments are provided which can be adjustably positioned on the mounting plate. Each of the forming segments is shaped to guide the packaging film from a generally flat configuration to a tubular configuration extending about the forming tube.

In accordance with the illustrated embodiment, to provide adjustable positioning of the forming segments, at least one of: (1) each of the first and second forming segments, and (2) the mounting plate, define at least one elongated adjustment slot for receiving a mechanical fastener for securing each of the forming segments to the mounting plate. By this arrangement, the first and second forming segments can be selectively positioned toward and away from to each other on the mounting place, and thus adjustably positioned with respect to the forming tube, to thereby selectively adjust that size of the package being formed and filled.

In the illustrated embodiment, each of the first and second forming segments defines the at least one elongated adjustment slot for receiving the mechanical fastener for securing each of the forming segments to the mounting plate.

To facilitate efficient and accurate adjustment of the first and second forming segments, the present assembly preferably includes indexing indicia for indicating the position of each of said first and second forming segments with respect to said mounting plate, to thereby position the first and second forming segments in symmetrical relationship to the forming tube.

In the illustrated embodiment, the indexing indicia comprises first and second pluralities of openings defined by the mounting plate on respective opposite sides of the forming tube, and a plurality of openings defined by each of the first and second forming segments. By this arrangement, one of the openings in each of the forming segments can be aligned with a respective one of the openings defined by the mounting plate to facilitate positioning of the forming segments in symmetrical relationship to the forming tube. In the preferred form, the first and second pluralities of openings defined by the mounting place are arranged on each side of the forming tube in diverging relationship.

To further facilitate efficient and accurate adjustable positioning of the first and second forming segments, the assembly includes positioning indicia provided on each of the first and second forming segments adjacent to the plurality of openings therein. This facilitates alignment of the openings in each of the forming segments with the openings in mounting plate to position the forming segments in symmetrical relationship to said forming tube.

In the illustrated embodiment, the present adjustable forming collar assembly includes first and second rib cages respectively extending along opposite sides of said forming tube, generally beneath the first and second forming segments. These rib cages guide the packaging film as it is drawn along the forming tube. In the preferred form, at least one interchangeable rib cage support member is provided which can be interchanged to vary the spacing between said first and second rib cages. Again, this facilitates forming and filling of differently sized packages.

Other objects, features, and advantages of the invention will become apparent from following detailed description, the appended drawings, and the accompanying claims.

DETAILED DESCRIPTION OF THE PREFERRED EMBODIMENT

Figure 1:
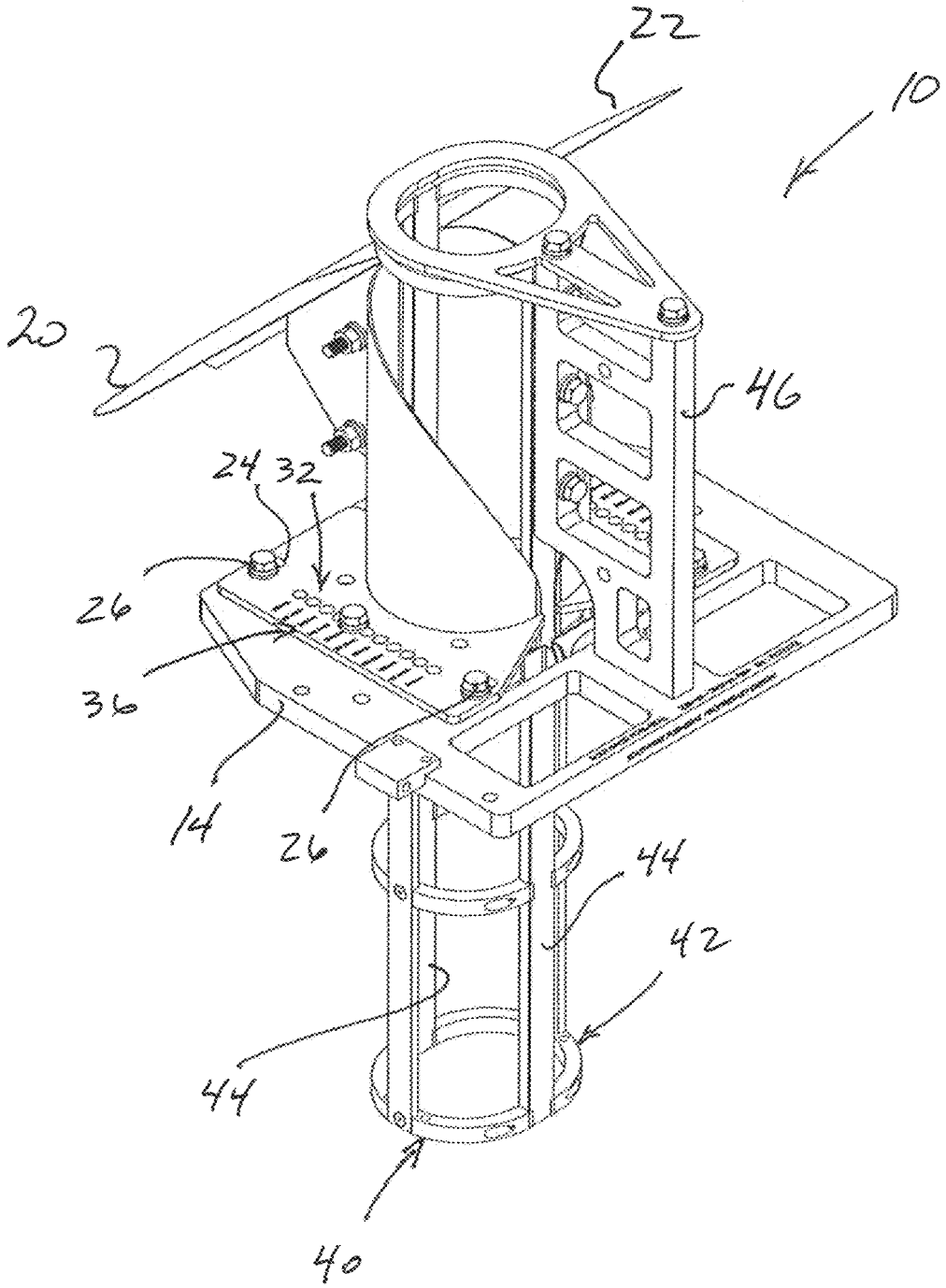
FIG. 1 is a diagrammatic, upper perspective view of an adjustable forming collar assembly embodying the principles of the present invention.

While the present invention is susceptible to embodiment in various forms, there is shown in the drawings and will hereinafter be described a presently preferred embodiment, with understanding the present disclosure is intended as an exemplification of the invention, and is not intended to limit the invention to the specific embodiment illustrated.

Vertical Form, Fill and Seal (VFFS) packaging machines create packages of a general shape called a pillow pack. The pillow pack shape is created by passing a film web through a forming collar assembly (FCA) to create a round, rectangular, or oval shape. The present adjustable forming collar assembly can create incrementally sized, multiple bag widths with a relatively simple set of changeout parts and basic tools.

The forming collar is the feature on the forming collar assembly that causes the packaging film to transition from a flat roll to a circular shape. The product tube is a feature on the forming collar assembly that transports the product being packaged into the formed, circular packaging film. Additionally, the product tube supports the film web until the product is sealed into the package along a longitudinal back seal.

The unique design features of the present adjustable forming collar assembly include two key features: the adjustable forming collar, and film support "rib cage". Both features work in tandem to allow the adjustable forming collar assembly to function as designed.

A traditional forming collar is a one-piece subassembly of the forming collar assembly. As will be further described, the present adjustable forming collar assembly has a segmented, split, two-piece forming collar. The split is on the centerline of the collar and bisects the collar into two pieces creating a left-hand and right-hand collar, designated first and second forming segments. These two pieces are mirror images of each other.

These two collar halves, or segments, are mounted on a base, or mounting plate, that has an incrementally spaced set of mounting holes that allow the forming collar halves to be spaced farther apart (or closer together) at incremental distances. A gap is created between the two forming collar halves of ever widening distances as the forming collars halves are adjusted for larger sizes. Change-out tooling in the form of an interchangeable spacer of a specific size for each incremental bag size is installed into the gap thereby providing a support surface for the packaging film.

The second key piece of this design is the product tube rib cage. Similar to the forming collar, the rib cage is split into left-hand and right-hand sections that can be adjustable left and right using change-out tooling. The product tube is designed with a split circular cross section in the vertical direction.

The rib cage change-out parts function like the change-out parts for the forming collar allowing the rib cage to be spaced farther apart or closer together to adjust to a specific cross-section. These product tube change-out parts give the appearance of a rib cage, a feature that is entirely unique to the present adjustable forming collar assembly.

With reference now to the drawings, and in accordance with the present invention, an adjustable forming collar 10 is a unique forming collar design that allows a traditional forming collar to be adjusted for multiple bag sizes on the same platform base using change-out parts. Versatile use of the associated vertical form, fill and seal (VFFS) apparatus is thus facilitated, including efficient reconfiguration for filling of differently sized packages.

Figure 3:
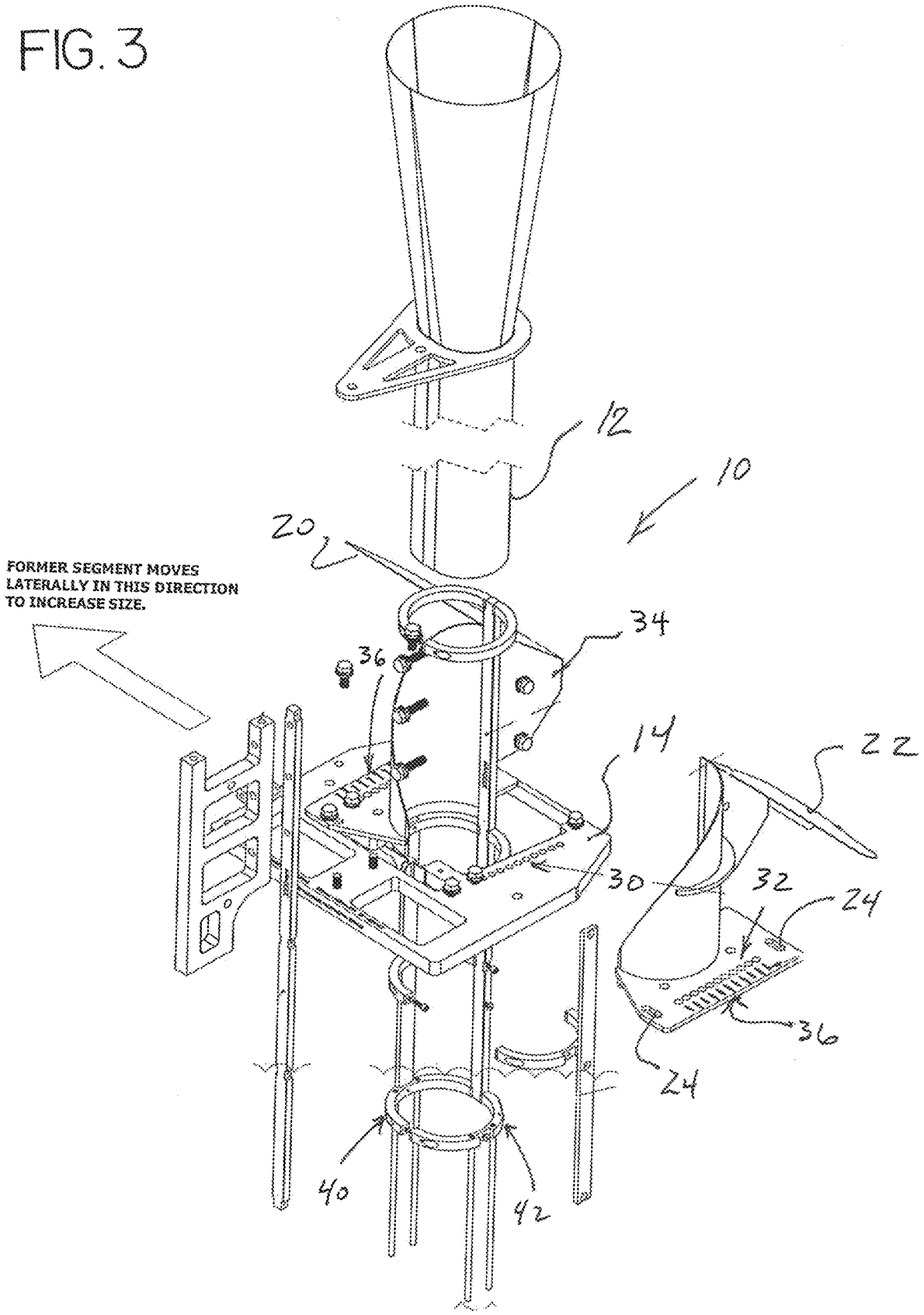
FIG. 3 is a diagrammatic, partially exploded perspective view of the present adjustable forming collar assembly.

In accordance with the illustrated embodiment, an adjustable forming collar assembly 10 is provided for a form, fill and seal apparatus having a forming tube 12 (FIG. 3) about which packaging film is positioned for formation and filling of a package. The product tube 12 is shown with an associated product tunnel through which product is delivered for package filling, and is typically of a fixed size.

The forming collar assembly 10 includes a mounting plate 14 positioned to extend laterally on opposite sides of the forming tube 12. To accommodate filling of packages of differing sizes, first and second forming segments 20, 22 are provided which can be adjustably positioned on the mounting plate 14. Each of the forming segments 20, 22 is shaped to guide the packaging film from a generally flat configuration to a tubular configuration extending about the forming tube 12.

To provide adjustable positioning of the forming segments 20, 22, at least one of: (1) each of the first and second forming segments 20, 22, and (2) the mounting plate 14, define at least one elongated adjustment slot 24 for receiving a mechanical fastener 26 for securing each of the forming segments 20, 22 to the mounting plate 14. By this arrangement, the first and second forming segments 20, 22 can be selectively positioned toward and away from to each other on the mounting plate 14, and thus adjustably positioned with respect to the forming tube 12, to thereby selectively adjust that size of the package being formed and filled. It will be appreciated that it is within the purview of the present invention to provide an alternative arrangement for selective adjustment of the positioning of the first and second forming segments with respect to the associated forming tube 12.

In the illustrated embodiment, each of the first and second forming segments 20, 22 defines the at least one elongated adjustment slot 24 for receiving the mechanical fastener 26 for securing each of the forming segments to the mounting plate 14.

To facilitate efficient and accurate adjustment of the first and second forming segments 20, 22, the present assembly preferably includes indexing indicia for indicating the position of each of said first and second forming segments with respect to said mounting plate 14, to thereby position the first and second forming segments in symmetrical relationship to the forming tube 12.

Figure 2:
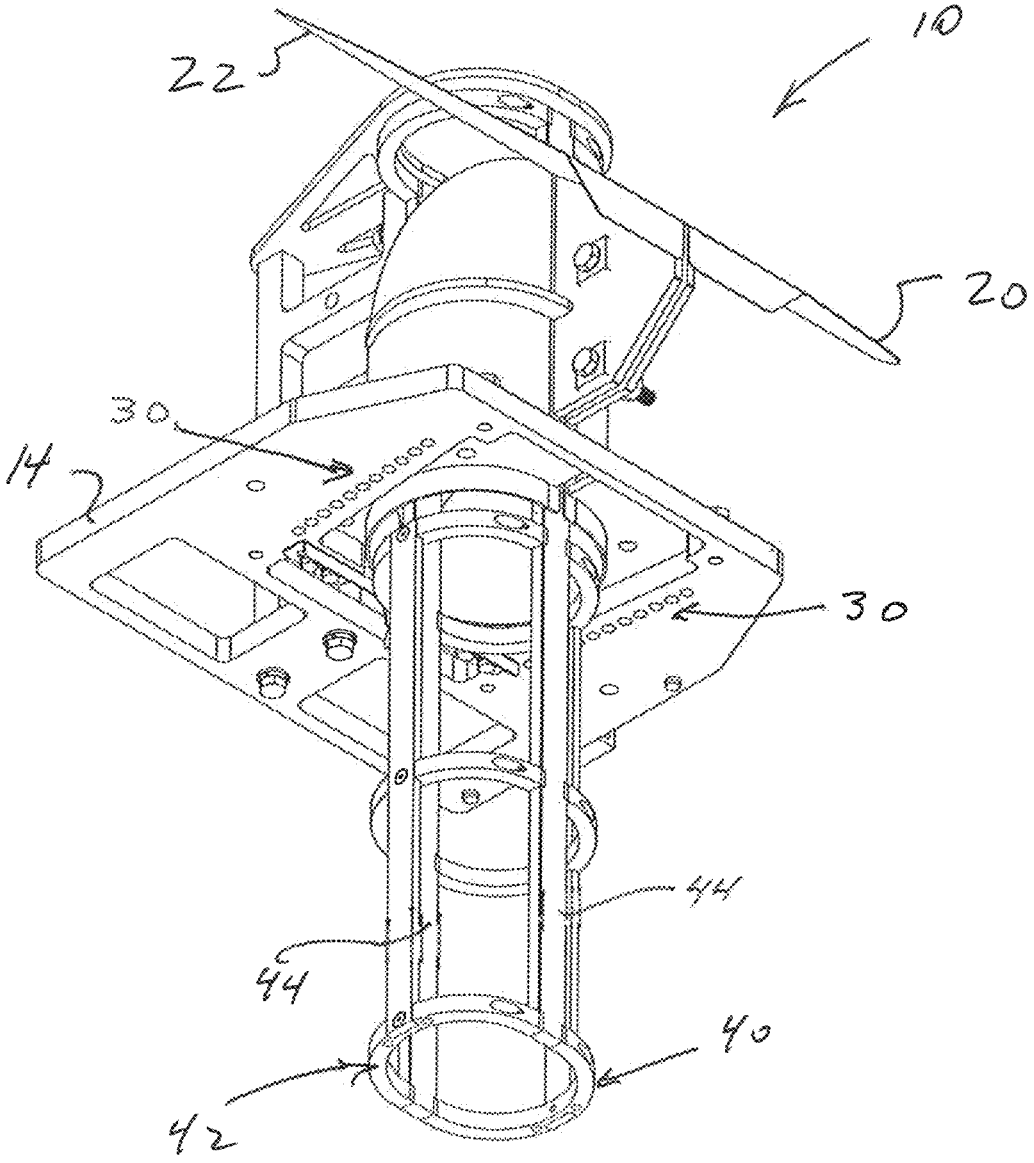
FIG. 2 is a diagrammatic, lower perspective view of the present adjustable forming collar assembly.

In the illustrated embodiment, the indexing indicia comprises first and second pluralities of openings 30 defined by the mounting plate 14 on respective opposite sides of the forming tube, and a plurality of openings 32 defined by each of the first and second forming segments 20, 22. By this arrangement, one of the openings 32 in each of the forming segments can be aligned with a respective one of the openings 30 defined by the mounting plate 14 to facilitate positioning of the forming segments in symmetrical relationship to the forming tube 12. In the preferred form, as shown in FIG. 2, the first and second pluralities of openings 32 defined by the mounting place 14 are arranged on each side of the forming tube 12 in diverging relationship. Change-out tooling in the form of an interchangeable spacer 34 of a specific size for each incremental bag size is installed into the gap between the first and second forming segments thereby providing a support surface for the packaging film.

To further facilitate efficient and accurate adjustable positioning of the first and second forming segments 20, 22, the assembly 10 includes positioning indicia 36 provided on each of the first and second forming segments 20, 22 adjacent to the plurality of openings 30 therein. This facilitates alignment of the openings 30 in each of the forming segments with the openings 32 in the mounting plate 14 to position the forming segments in symmetrical relationship to the forming tube 12.

In the illustrated embodiment the present adjustable forming collar assembly 10 includes first and second rib cages 40, 42 respectively extending along opposite sides of the forming tube 12, which typically extends vertically through the adjustable forming collar assembly 10. These rib cages 40, 42 guide the packaging film as it is drawn along the forming tube 12. In the preferred form, at least one interchangeable rib cage support member 44 is provided, supported by a mounting bracket 46 secured to mounting plate 14. The rib cage support member 44 can be interchanged to selectively vary the spacing between said first and second rib cages 40, 42. In the illustrated form, a pair of the support members 44 are provided, generally at the front and rear of the forming tube 12. Again, this facilitates formation and filling of differently sized packages.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

The invention claimed is:

1. A form, fill, and seal apparatus comprising:

a forming tube about which packaging film is positioned for formation and filling of a package;

a mounting plate positioned to extend laterally on opposite sides of said forming tube; and first and second forming segments adjustably positioned on said mounting plate, each of said forming segments being shaped to guide said packaging film from a flat configuration to a tubular configuration extending about said forming tube, the forming tube being located between the first and second forming segments, at least one of: (1) each of said first and second forming segments, and (2) said mounting plate, defining at least one elongated adjustment slot for receiving a mechanical fastener for securing each of said forming segments to said mounting plate, so that said first and second forming segments can be selectively positioned toward and away from each other and the forming tube on said mounting plate, to thereby selectively adjust a size of said package being formed and filled.

2. A form, fill, and seal apparatus in accordance with claim 1, wherein each of said first and second forming segments defines said at least one elongated adjustment slot for receiving the mechanical fastener for securing each of the forming segments to said mounting plate.

3. An adjustable forming collar assembly for a form, fill, and seal apparatus having a forming tube about which packaging film is positioned for formation and filling of a package, said assembly comprising:

a mounting plate positioned to extend laterally on opposite sides of said forming tube:

first and second forming segments adjustably positioned on said mounting plate, each of said forming segments being shaped to guide said packaging film from a flat configuration to a tubular configuration extending about said forming tube;

at least one of: (1) each of said first and second forming segments, and (2) said mounting plate, defining at least one elongated adjustment slot for receiving a mechanical fastener for securing each of said forming segments to said mounting plate, so that said first and second forming segments can be selectively positioned toward and away from each other on said mounting plate, to thereby selectively adjust a size of said package being formed and filled, said assembly further including indexing indicia for indicating a position of each of said first and second forming segments with respect to said mounting plate, to position said first and second forming segments in symmetrical relationship to said forming tube.

4. An adjustable forming collar assembly in accordance with claim 3, wherein said indexing indicia comprises first and second pluralities of openings defined by said mounting plate on respective opposite sides of said forming tube, and a plurality of openings defined by each of said first and second forming segments, whereby one of the openings in each of said forming segments can be aligned with a respective one of said openings defined by said mounting plate to facilitate positioning of said forming segments in symmetrical relationship to said forming tube.

5. An adjustable forming collar assembly in accordance with claim 4, wherein said first and second pluralities of openings defined by said mounting plate are arranged on each side of said forming tube in diverging relationship.

6. An adjustable forming collar assembly in accordance with claim 4, including position indicia provided on each of said first and second forming segments adjacent to said plurality of openings therein, to facilitate alignment of said openings in each of said forming segments with said openings in the mounting plate to position said forming segments in symmetrical relationship to said forming tube.

7. An adjustable forming collar assembly for a form, fill, and seal apparatus having a forming tube about which packaging film is positioned for formation and filling of a package, said assembly comprising:

a mounting plate positioned to extend laterally on opposite sides of said forming tube:

first and second forming segments adjustably positioned on said mounting plate, each of said forming segments being shaped to guide said packaging film from a flat configuration to a tubular configuration extending about said forming tube;

at least one of: (1) each of said first and second forming segments, and (2) said mounting plate, defining at least one elongated adjustment slot for receiving a mechanical fastener for securing each of said forming segments to said mounting plate, so that said first and second forming segments can be selectively positioned toward and away from each other on said mounting plate, to thereby selectively adjust a size of said package being formed and filled, said assembly further including an interchangeable spacer positionable between said first and second forming segments.

8. An adjustable forming collar assembly for a form, fill, and seal apparatus having a forming tube about which packaging film is positioned for formation and filling of a package, said assembly comprising:

a mounting plate positioned to extend laterally on opposite sides of said forming tube:

first and second forming segments adjustably positioned on said mounting plate, each of said forming segments being shaped to guide said packaging film from a flat configuration to a tubular configuration extending about said forming tube;

at least one of: (1) each of said first and second forming segments, and (2) said mounting plate, defining at least one elongated adjustment slot for receiving a mechanical fastener for securing each of said forming segments to said mounting plate, so that said first and second forming segments can be selectively positioned toward and away from each other on said mounting plate, to thereby selectively adjust a size of said package being formed and filled, said assembly including first and second rib cages respectively extending along opposite sides of said forming tube, said assembly including at least one interchangeable rib cage support member which can be interchanged to vary a spacing between said first and second rib cages, to thereby facilitate forming and filling of differently sized packages.

* * * * *